US006378273B1

(12) United States Patent
Trani et al.

(10) Patent No.: US 6,378,273 B1
(45) Date of Patent: Apr. 30, 2002

(54) METHOD FOR OBTAINING DIMENSIONALLY AND STRUCTURALLY STABLE OBJECTS, IN PARTICULAR DISPOSABLE CONTAINERS, STARTING FROM FLEXIBLE FILM, AND OBJECT OBTAINED BY THE METHOD

(75) Inventors: Giorgio Trani; Marion Sterner, both of Venezia; Giovanni Manfre', Caldiero, all of (IT)

(73) Assignees: Gruppo X Di X Gruppo S.R.L., Venezia (IT); BP Europack S.p.A., Lugo Di Vicenza ( * ) Notice: Subject to any disclaimer, the term of this patent is extended or adjusted under 35 U.S.C. 154(b) by 0 days.

(21) Appl. No.: 09/403,225

(22) PCT Filed: Apr. 15, 1998

(86) PCT No.: PCT/EP98/02210

§ 371 Date: Oct. 15, 1999

§ 102(e) Date: Oct. 15, 1999

(87) PCT Pub. No.: WO98/47766

PCT Pub. Date: Oct. 29, 1998

(30) Foreign Application Priority Data

Apr. 17, 1997 (IT) ..... VE97A0013
Jun. 25, 1997 (IT) ..... VE97A0025

(51) Int. Cl.[7] ..... B65B 9/20; B65B 61/00

(52) U.S. Cl. ..... 53/450; 53/452; 53/451; 53/141

(58) Field of Search ..... 53/140, 141, 450, 53/452, 453; 264/446, 484, 405, 485, 486, 488, 489, 491, 492, 495; 493/59, 467; 220/660

(56) References Cited

U.S. PATENT DOCUMENTS

| | | | | | |
|---|---|---|---|---|---|
| 2,411,622 | A | * | 11/1946 | Guyer | 493/110 |
| 2,770,406 | A | * | 11/1956 | Lane | 493/59 |
| 3,189,505 | A | * | 6/1965 | Sloan | 53/140 |
| 3,648,834 | A | | 3/1972 | Mayer | 53/450 |
| 4,437,850 | A | * | 3/1984 | Ono | 493/110 |
| 4,446,969 | A | * | 5/1984 | Tyler | 220/660 |
| 4,781,012 | A | * | 11/1988 | Reil | 53/452 |
| 4,988,469 | A | * | 1/1991 | Reavely | 264/113 |
| 5,733,496 | A | * | 3/1998 | Avellanet | 264/485 |
| 5,866,060 | A | * | 2/1999 | Buckley | 264/489 |

* cited by examiner

*Primary Examiner*—John Sipos
(74) *Attorney, Agent, or Firm*—Birch, Stewart, Kolasch & Birch, LLP

(57) ABSTRACT

A method for obtaining dimensionally and structurally stable objects, in particular disposable containers, from a flexible film rewindable on a reel, comprising the steps of preparing a flexible film rewindable on a reel, which, at least in those regions which in the obtained object are required to be substantially rigid, is associated with a structurally transformable substance inert with respect to the film and at least one passive activator therefor, forming an object from the film prepared in this manner, and during any one stage in a formation of the object, administering an energy compatible with the activator to start a structural transformation reaction of the substance and convert the regions from flexible to substantially rigid.

40 Claims, 4 Drawing Sheets

METHOD FOR OBTAINING DIMENSIONALLY AND STRUCTURALLY STABLE OBJECTS, IN PARTICULAR DISPOSABLE CONTAINERS, STARTING FROM FLEXIBLE FILM, AND OBJECT OBTAINED BY THE METHOD

This application is the national phase under 35 U.S.C. §371 of PCT International Application No. PCT/EP98/02210 which has an International filing date of Apr. 15, 1998, which designated the United States of America.

This invention relates to a method for obtaining dimensionally and structurally stable objects, in particular disposable containers, starting from flexible film, and an object obtained by the method.

Disposable containers are known obtained from sheets of resistant paper, generally plastic-coated, which are unwound from reels and subjected to successive welding, folding and possibly forming processes to assume the desired spatial shape. Their filling with liquid, granular or powdery products can be effected either during the container formation or after it has been completely formed.

These known disposable containers are advantageous in terms of their stability, stackability, shelf display, strength, product protection, ease of preservation, use and reclosability. However they are rather heavy and costly, and are difficultly disposable as they are difficult to crumple.

Flexible disposable containers obtained from plastic film such as polyethylene are also known, these being essentially free of the drawbacks of rigid containers. In particular, they are of low cost, small overall size, of easy disposal, and simple, practical and advantageous to machine-fabricate starting from reels. They are however virtually without dimensional stability and consequently not easy to stack, while in addition having commercial limitations as they cannot be displayed on shelves.

U.S. Pat. No. 3,648,834 discloses a method of forming a package from a flexible film containing a plasticizer or other constituent which is capable of being polymerized upon being irradiated from a high energy source. After enclosing a product in such a packaging film, the thus formed package is subjected to a controlled amount of irradiation from a high energy source to produce cross-linking within the plasticizer or other constituent which results in the flexible packaging film becoming rigid.

An object of the invention is to eliminate the drawbacks of known containers of the various types while at the same time retaining their advantages.

U.S. Pat. No. 3,648,834 discloses a method of forming a package from a flexible film containing a plasticizer or other constituent which is capable of being polymerized upon being irradiated from a high energy source. After enclosing a product in such a packaging film, the thus formed package is subjected to a controlled amount of irradiation from a high energy source to produce cross-linking within the plasticizer or other constituent which results in the flexible packaging film becoming rigid.

An object of the invention is to eliminate the drawbacks of known containers of the various types while at the same time retaining their advantages.

A particular object of the invention is to obtain disposable containers, and objects generally, which present dimensional stability while at the same time being of low weight and cost and able to be crumpled to reduce their volume after use for easy disposal.

A further object of the invention is to provide disposable containers, and objects generally, starting from flexible film which before forming the container can be wound in a roll and hence occupy a considerably reduced space, to be stiffened only at the moment of formation of the container.

BRIEF SUMMARY OF THE INVENTION

These objects and others which will be apparent from the ensuing description are attained by a method for obtaining dimensionally and structurally stable objects, in particular disposable containers, from flexible film, rewindable on a reel, by:

preparing a flexible film rewindable on a reel, which, at least in those regions which in said obtained object are required to be substantially rigid, is associated with a structurally transformable substance inert with respect to said film and at least one passive activator therefor, forming an object from said film forming material prepared in this manner, and during any one stage in a formation of said object, administering an energy compatible with said activator to start a structural transformation reaction of said substance and convert said regions from flexible to substantially rigid.

BRIEF DESCRIPTION OF THE DRAWINGS

Some preferred embodiments of this invention are further clarified hereinafter with reference to the accompanying drawings, on which.

DESCRIPTION OF PREFERRED EMBODIMENTS

Figures 1, 2:
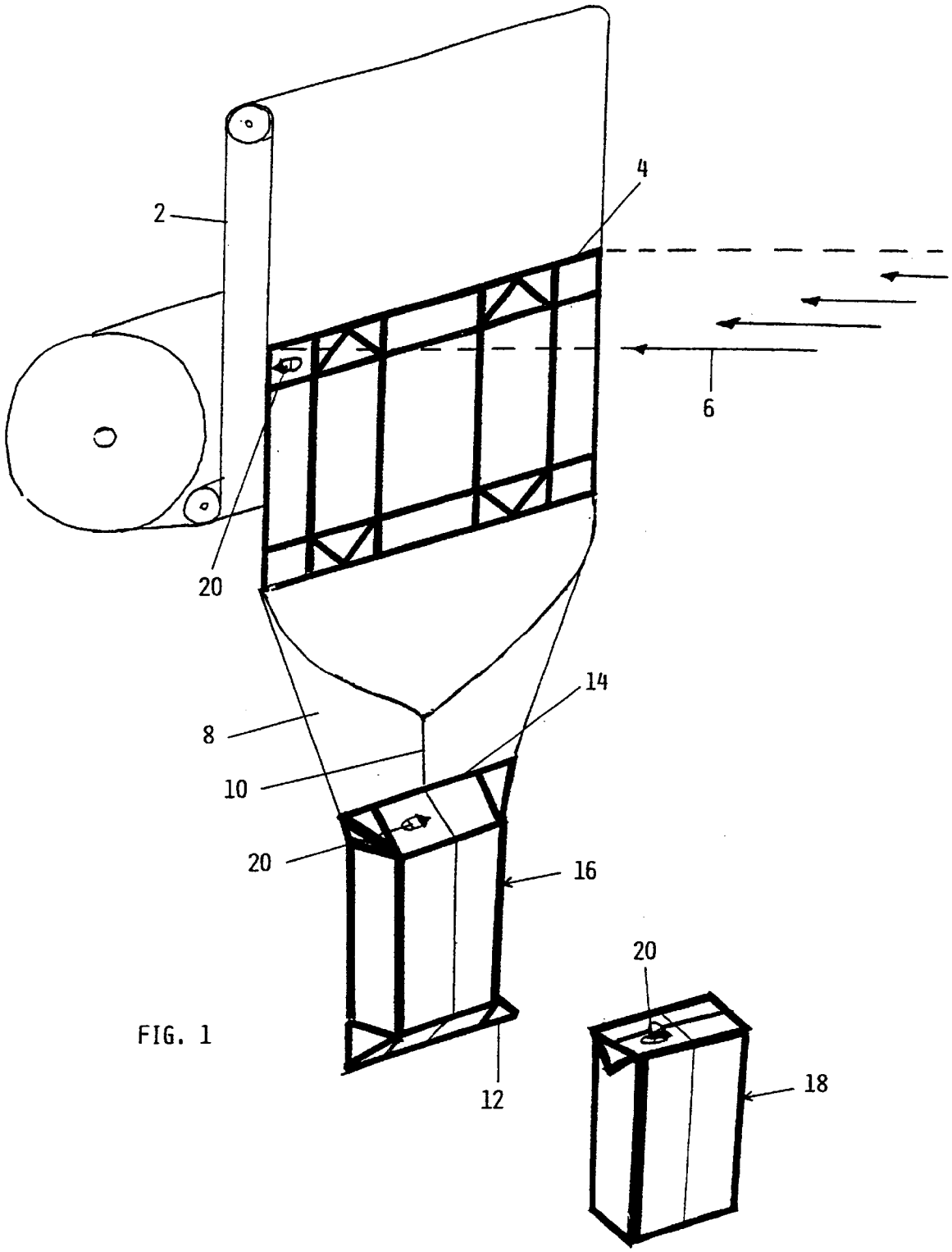
FIG. 1 schematically illustrates a first embodiment of the method of the invention.
FIG. 2 is a perspective view of a parallelepiped package obtained by the method.

Generally according to the invention, a transformable substance such as a polyester resin and a passive activator therefor are applied to one surface of a flexible film, for example of paper, polyethylene or other material. It is important that the resin and activator are of a type which does not interact significantly with the film, but is able to form an agglomerate therewith. The resin and activator are applied only to those parts which in the obtained container are required to be substantially rigid.

After this application the applied substance is allowed to dry, after which the thus treated film is rewound to await its future use by the packager.

At the moment of packaging, the previously treated flexible film is unwound and during its unwinding is fed with energy of predetermined power and wavelength depending on the type of activator chosen.

While the film is being fed with energy, this acts on the activator causing progressive structural modification of the resin, which becomes rigid to also stiffen the film parts with which it forms the agglomerate.

If before, during or after energy administration the previously treated film is subjected to traditional forming operations leading to the obtaining of a possibly filled package, the stiffening of the film parts on the basis of the aforedescribed mechanism provides sufficient dimensional stability to the package obtained, notwithstanding the fact that it is constructed of an essentially flexible base material. As a result, this package presents all the characteristics of a substantially rigid package while being of extremely low weight and hence cost, and able to be crumpled after use for easy disposal.

The new principle on which the present invention is based hence consists of preparing and using a flexible film which before or after the formation of the object to be obtained is fed with energy to consequently undergo a modification of its structure in those regions which in the finished object must be substantially rigid. It can be used in various ways and be of various materials.

In the currently described embodiment the resin is applied only to those regions of the film to stiffened, whereas energy is administered to the entire film surface.

In a different embodiment of the method of the invention, the resin is applied to the entire film surface whereas energy is administered only to those regions to be stiffened. This can be achieved using a suitable masking screen interposed between the treated film and the energy source.

In a further embodiment of the method of the invention, the resin is applied during the formation of the film. More particularly, the resin and its activator can be incorporated into the mass from which the flexible film is to be formed.

That film which has undergone total resin treatment, ie either by incorporating the resin into the mass to form the film or by applying the resin to the film already prepared, can also be firstly shaped to obtain the package, followed by total irradiation to completely stiffen it. In this case it can no longer be crumpled after use, but it preserves all the other stated advantages, and in particular the characteristic of being able to defer the stiffening of the flexible film until the moment in which this characteristic is required for utilization.

Various substances can be used to arrange the flexible film for local or widespread stiffening, their properties being known to the expert. Generally these substances are photopolymerizable unsaturated resins, acrylic resins, silicone, liquid crystals, polyester resins, etc.

The energy to be administered can also be of various types, and in general is chosen on the basis of the activator for the substance applied to the film and on the type of stiffening to be conferred on the object. This energy can be thermal, UV, visible or infrared radiation, electronic, ionic, electrchemical, electromagnetic, nuclear, etc.

In all these described embodiments it is also possible to apply to the flexible film, after application of the stiffening resin, a further film which, in contrast to the resin, is compatible with the substance to be contained in the package, in particular food substances, and/or with the outside environment. This latter requirement is important for example in the case of packages which can come into contact with children and must have an absolutely toxic-free outer surface.

A different embodiment of the method of the invention is based on the principle of utilizing, for the controlled stiffening of all or par of the flexible film, the properties of certain substances which increase their rigidity by electrochemical transformation., which takes place following contact with another substance, and occurs over a period which is sufficiently long to enable the object to be formed before completion of the transformation.

These substance, which are available in the liquid state in the form of solid particles or fibres, which can also be porous, can act in accordance with two different mechanisms, depending upon whether they present ablative or expanding properties.

In the first case, an ablative liquid, for example a silicone, able to pass into the gaseous state on administration of energy, is applied to the flexible film (paper) for example by spraying.

A further impermeable film is then applied to both sides of the film treated in this manner.

After forming the object, which is flexible, it is fed with heat, for example in an oven. In this manner the silicone ablative process takes place, it being converted into the gaseous state and, given its confinement within the micropores of the starting film and retained there by the two impermeable films, considerably increases its pressure, resulting in substantial stiffening and stability of the object obtained.

The same result can be obtained by using, instead of a substance with ablative properties, a structure with expanding properties (foaming), such as a polyurethane, a polypropylene, a polyethylene or an acetal substance.

If the starting film is of a non-porous material, the impermeable film can evidently be applied only to that side on which the ablative or foaming substance has been previously applied.

A further embodiment of the method of the invention is based on the property, possessed by some essentially fibrous substances, of undergoing controlled structural transformation by a shape memory phenomenon. These substances, known as SME (Shape Memory Effect) substances, consist of microfilaments or flexible fibres which can be applied to the film to be stiffened by adding them to the polymerizable mass from which the film is to be obtained, or by forming a mesh which is then applied to the film to be treated.

These microfilaments, which may be metal, or flexible fibres, have a highly flexible martensitic structure below the transformation temperature, however above this temperature they assume an austenitic structure, which confers rigidity on the object formed from the flexible film which incorporates them.

If these microfilaments have been added to the mass from which the flexible film is later obtained, the stiffening due to their structural transformation extends throughout the entire object.

If however these microfilaments have been applied only to those film regions which are to be stiffened in the formed object, the stiffening extends only to those regions.

In further embodiment of the method of the invention, controlled stiffening of a flexible film is achieved by utilizing the properties possessed by certain substances of forming composites, ie of binding together long or short-fibre or powder components.

According to this method, to the film to be stiffened there is applied a melamine formaldehyde which, when fed with energy, polycondenses and acts as an adhesive on the film fibres.

Alternatively a mix of melamine with fibre and powder can be extruded, so that when energized, the melamine binds the fibres together to at the same time stiffen the object obtained. In both cases the stiffening is achieved by virtue of the structure formed by the fibres held together by the adhesive.

The following examples, referred to the different embodiments of the method of the invention, clarify the invention in greater detail.

EXAMPLE 1

A mixture is prepared consisting of 60–70 vol % of an acylated urethane, of the type commercially known as Ebecryl 605, and 40–30% of a monoacrylate monomer, of the type commercially known as TPGDA 1997-02125, both produced by UCB Chemical Ltd. This mixture is poured onto a porous polyethylene film of thickness 10–100 microns to fill its pores. An activator of the type commercially known as Irgocure 651, produced by Ciba Geigy AG, is then poured in a quantity of 3–5 vol % of the mixture onto the film on which there is then applied a second polyethylene film of thickness 200 microns. A container of dimensions 10×10×15 cm is constructed from this film using traditional forming techniques.

All the corners of the container are then irradiated with four UV lamps of 80 watt/cm power, produced by Quantum S.R.L., at a rate of 20 cm/min. In this manner a dimensionally stable container with stiffened but non-fragile corners is obtained, suitable for containing solid or liquid foods.

EXAMPLE 2

An ablative polymer consisting of a sprayable rigid silicone material of the type known commercially as CPC 1050, produced by GE, is sprayed onto the film of the previous example. The liquid quantity sprayed is chosen such as to create an agglomerate with about 10 vol % of ablative silicone on the polyethylene film volume. A further film is then applied to the film treated in this manner, to form a sandwich which sealedly retains the silicone material.

After the edges of the two films have been welded together, the sandwich film obtained in this manner, is used to form a container, which was then placed in an oven at a temperature of more then 100° C. The ablative process gave rise to the formation of gas at high pressure which conferred rigidity to the entire container.

EXAMPLE 3

Using the method of the previous example, instead of an ablative silicone the polyethylene film was given an application of polyurethane, which on transformation into foam stiffened the container.

EXAMPLE 4

A microfilament mesh of 100–150 micron thickness and with square apertures of 1 mm was prepared from a nickel-titanium alloy produced by the Furukawa Company, and showed high flexibility in its martensitic structure at ambient temperature. This mesh was applied to a 10–100 micron thick polyethylene film, which preserved its flexibility.

A second film was then applied to this film to obtain a sandwich film of about 300 micron total thickness.

This was used to form a container which was then heated to above the austenitic transform temperature of the microfilament mesh (about 75° C.) or 5 minutes in an oven. Following the austenitic transformation the container became irreversibly rigid. The mesh was applied to the film only in those regions corresponding to the container corners, these corners becoming rigid to an extent four times greater than the remaining parts of the container. The width of the mesh regions was about 2 mm, and in the rigid regions the volume of the mesh microfilaments did not exceed 10% of the entire volume of the agglomerate.

Some preferred container construction methods are described hereinafter with reference to the figures.

FIG. 1 shows schematically a flexible film 2, to which a polyethylene resin and a passive activator therefor have been applied to a measured extent in bands 4 which are to form the corners in the package to be obtained (the example relates to a parallelepiped package).

When the package is to be formed, the previously treated flexible film 2 is unwound and is subjected, gradually as it is unwound, to the administration of thermal energy 6, which cross-links the resin with consequent stiffening thereof and of the film with which it forms the agglomerate.

The film treated and partially stiffened in this manner is longitudinally folded-over and is joined together along its longitudinal edges to form a sort of continuous tubular element 8.

It is then welded along a transverse line and filled with a liquid, past, powdery or granular product, then welded above the filled portion and cut along the weld band 14, to be separated into a container which is finally subjected to traditional folding and/or forming techniques to attain the desired final configuration 18.

If the package is to be made easily tearable along its contents delivery aperture notwithstanding the substantial flexibility of the package walls and hence their difficulty of tearing, the polyethylene resin and its activator are also sprayed on the region scheduled for the delivery aperture. In this manner, that part, on being stiffened by virtue of the cross-linking, is converted into a sort of blade 20 which can be easily torn by simply pressing the surrounding wall of the package with a finger.

In a modified embodiment not shown on the drawings, after the roll of flexible film has been sprayed to a measured extent on the regions to be stiffened, the film is subjected to UV radiation at least on the previously sprayed regions, and is then welded along its longitudinal edges to form a tube, which is then punched to obtain pieces of shape and dimensions corresponding to the package to be obtained. The pieces or empty packages obtained in this manner are maintained "flat" and are arranged in packs or stacks which are transferred in this state to the packaging machine.

Here the package are filled one by one and are then closed and shaped to assume the desired three-dimensional configuration, which can be the result either of the mere filling itself, or of filling followed by forming.

Figures 3, 4:
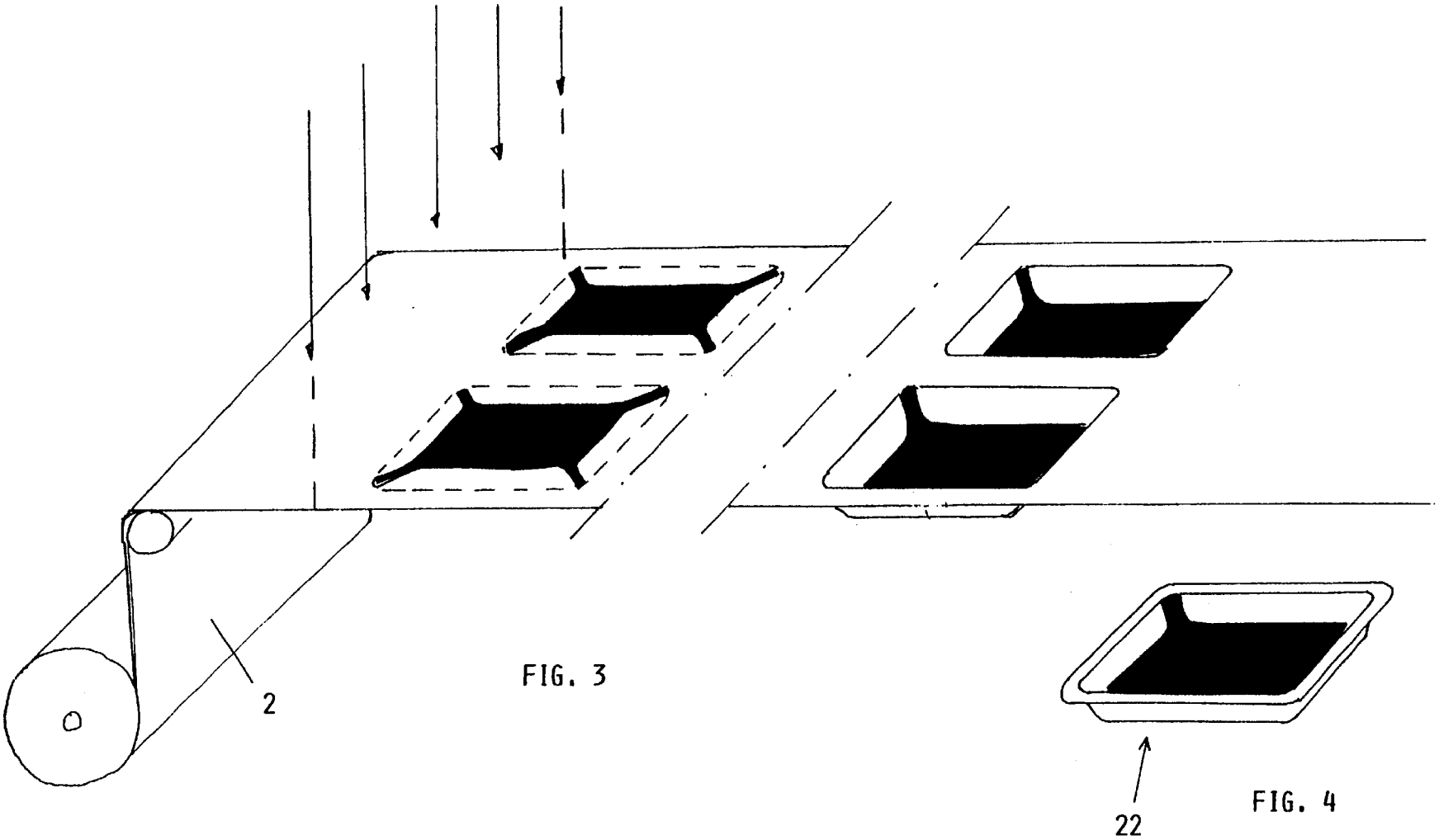
FIG. 3 illustrates a second embodiment thereof.
FIG. 4 is a perspective view of a package obtained by the method, FIG. 5 schematically illustrates a third embodiment of the method of the invention.

FIG. 3 schematically illustrates the method for constructing open package, for example trays 22. In this case the flexible film 2, sprayed with the polyethylene resin and rewound, is fed as in the first example to the packaging machine, where at the moment of forming the package it is unwound and subjected to a thermoforming process in accordance with one of the traditional techcniques. In particular, this thermoforming process comprises a stage in which the flexible film is preheated, a subsequent stage in which it is irradiated with UV, and a final stage in which the preheated and irradiated film is formed, which forming can take place in a mould by vacuum or blow-moulding or by deformation by a die and punch, and can involve a single tray or several trays at a time.

Independently of the forming technique used, on termination of this latter a tray 22 of flexible material is obtained, with its corners and possibly its base stiffened, and hence able to provide dimensional stability to the tray. This can then be fed to subsequent steps including filling, the application of a cover film by welding, and final punching of the closed tray.

Figure 5:
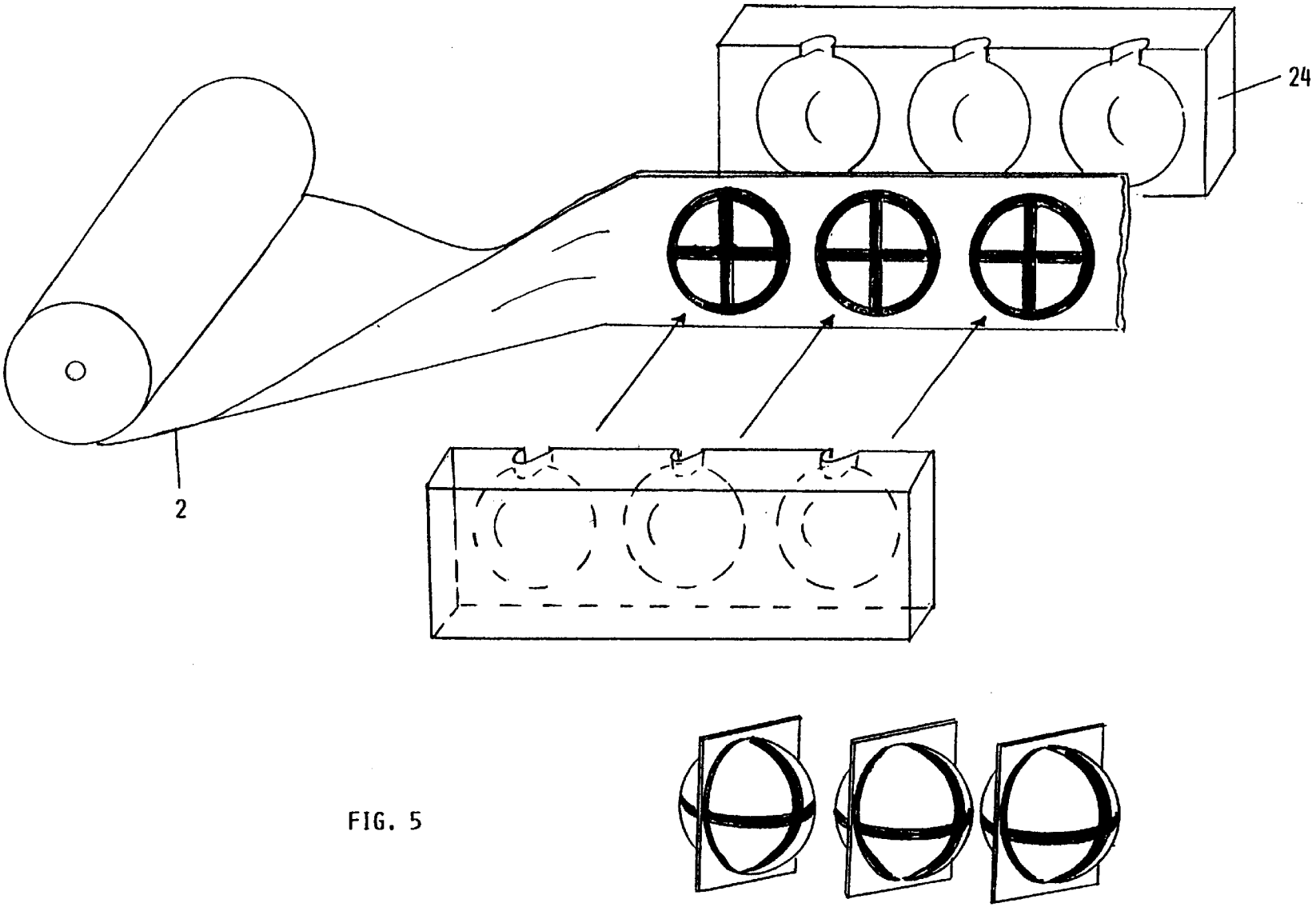

FIG. 5 illustrates a further container forming method.

According to this method the film 2 is sprayed over its entire surface with the stiffening substance and its activator.

At the moment of packaging the film is folded longitudinally into two parts and made to pass between two half-moulds 24 comprising a plurality of mutually facing cavities. During this passage the two flaps of the film 2 are thermally welded together along the edges of the cavities, and the interior of the space bounded in this manner is filled with air or directly with the product to be packaged, so as in either case to cause the two film flaps to expand and to adhere to the concave wall of both cavities. The two half-moulds 24 are partially heated, ie are heated in certain regions, to achieve a temperature higher than the minimum temperature which causes structural transformation of the hardening substance, whereas the remain regions of the two half-moulds are maintained below this temperature. Different packages are obtained depending on the position of these regions.

For example, if the heated regions are the edges of the cavity of the two half-moulds, the package obtained is flexible with the exception of the weld band of the two half-packages. If instead the heated regions are the edges of the cavity of the two half-moulds or other bands traversing the half-packages, these will also be stiffened. Finally, if only these latter are heated, the package will be stiffened only thereat.

Figure 6:
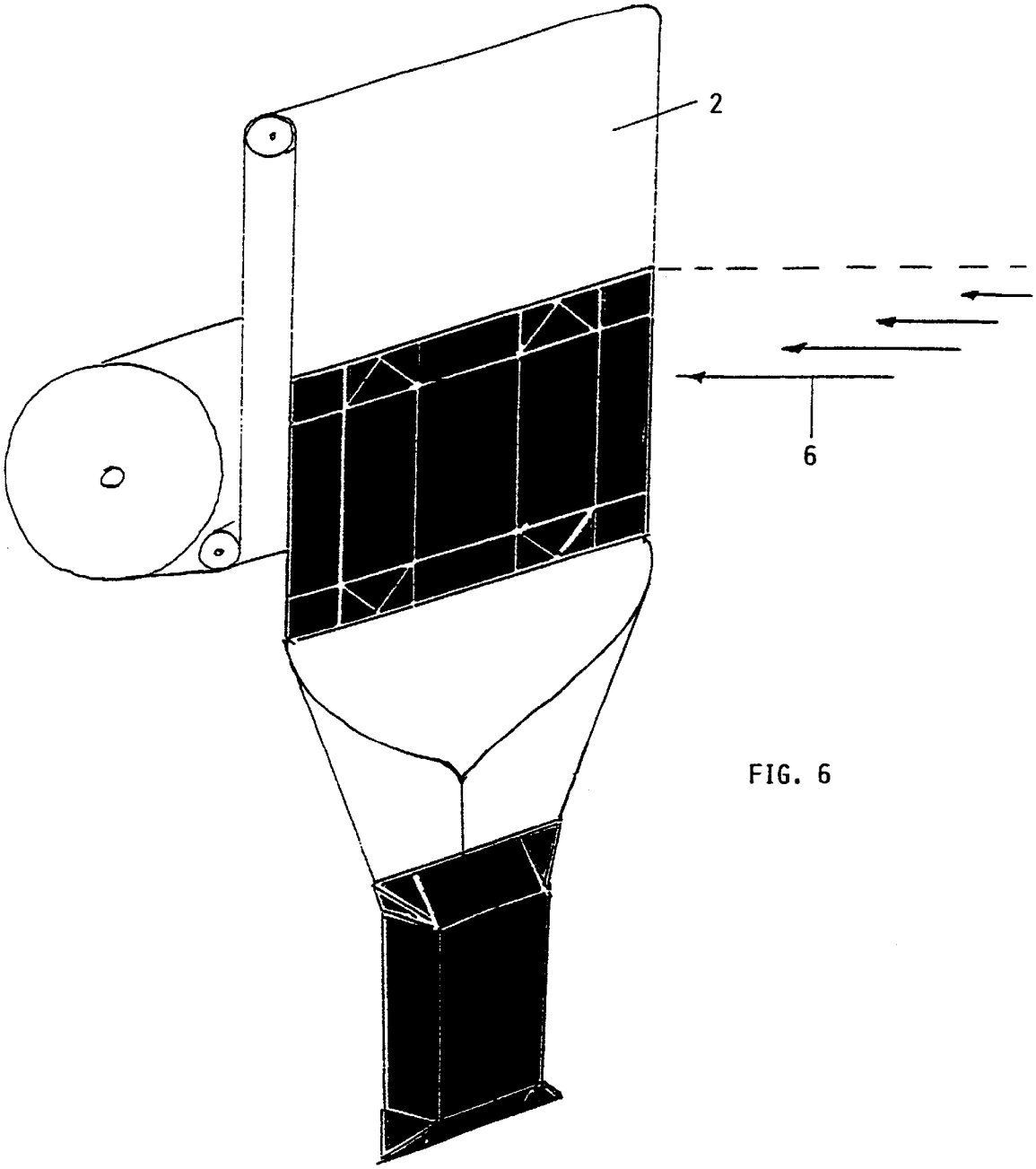
FIG. 6 illustrates a fourth embodiment thereof.

In all the schematically illustrated methods the final package is rigid along certain bands and flexible along all the wall bounded by said bands. Moreover, by spraying complementary regions with lacquer, the same techniques enable packages to be obtained having substantially rigid walls which can be mutually articulated at the corners so as to be able to be flattened after use and again occupy a very small space. FIG. 6 shows schematically the method for obtaining a package analogous to that of FIG. 1, but with the rigid regions and flexible regions inverted, in accordance with the method just described.

In a further method of the invention, instead of applying the hardening resin and its activator by spraying over the entire surface of the flexible film, a second flexible film made of a structurally transformable substance is coupled to the film 2 and then fed with energy only in those regions to be hardened (for example by radiation of measured extent).

In a further embodiment of the method one of the two components of a two-component polymerization system is applied to the flexible film, the second component being applied at the time of forming the package. To obtain localized rigidity in this package, one of the two components must be applied to only measured extent.

What is claimed is:

1. A method for obtaining dimensionally and structurally stable objects from a flexible film rewindable on a reel, comprising the steps of:

preparing a flexible film rewindable on a reel, which, in local regions which are required to be substantially rigid, is associated with a structurally transformable substance inert with respect to said film and at least one passive activator therefor, forming an object from said film prepared in this manner, and during any stage in a formation of said object prior to completion of the forming of the object, administering an energy compatible with said activator to said local regions to only initiate a structural transformation reaction of said substance and convert said locals regions from flexible to substantially rigid wherein the administering of energy is selectively directed to said local regions to initiate the structural transformation therein on command during said any one stage.

2. A method as claimed in claim 1 said substance and said activator being of a type not significantly interacting with said film, but able to form an agglomerate therewith.

3. A method as claimed in claim 1 the flexible film starting from a liquid prepolymer mixed with reinforcing components of fibrous and/or pulverulent type, to thereby obtain a matrix reinforced with reinforcing elements.

4. A method as claimed in claim 2, characterised by using structurally transformable substances with ablative properties, confined between gas-impermeable films.

5. A method as claimed in claim 2, characterised by using structurally transformable substances with expanding properties, confined between gas-impermeable films.

6. A method as claimed in claim 2, characterised by applying the structurally transformable substance and its passive activator to the flexible film after it has been prepared.

7. A method as claimed in claim 1, characterised by using a cross-linkable substance as the structurally transformable substance.

8. A method as claimed in claim 1, characterised by using a polymerizable substance as the structurally transformable substance.

9. A method as claimed in claim 2, characterised by applying to the flexible film a shape memory structure based on microfilaments or flexible fibres, which is maintained at a temperature lower than the austenitic transformation temperature and, after having formed the object, is heated to a temperature higher than said austenitic transformation temperature, to obtain the irreversible transformation of said structure from flexible to substantially rigid.

10. A method as claimed in claim 2, characterised by using a photopolymerizable unsaturated resin as the transformable substance.

11. A method as claimed in claim 10, characterised by using an acrylated urethane as the structurally transformable substance.

12. A method as claimed in claim 10, characterised by using a monoacrylate monomer as the structurally transformable substance.

13. A method as claimed in claim 10, characterised by using a mixture of an acylated urethane and a monoacrylate monomer as the structurally transformable substance.

14. A method as claimed in claim 11, characterised by using a hydroxycyclohexylphenylketone as the activator for the structurally transformable substance.

15. A method as claimed in claim 4, characterised by using a silicone as the structurally transformable substance.

16. A method as claimed in claim 5, characterised by using a polyurethane as the structurally transformable substance.

17. A method as claimed in claim 5, characterised by using a polypropylene as the structurally transformable substance.

18. A method as claimed in claim 5, characterised by using a polyethylene as the structurally transformable substance.

19. A method as claimed in claim 5, characterised by using an acetal substance as the structurally transformable substance.

20. A method as claimed in claim 3, characterised in that the film is prepared form a formaldehyde melamine.

21. A method as claimed in claim 1, characterised by subjecting the film to thermal energy.

22. A method as claimed in claim 1, characterised by subjecting the film UV radiation.

23. A method as claimed in claim 1, characterised by subjecting the film to IR energy.

24. A method as claimed in claim 1, characterised by subjecting the film to visible energy.

25. A method as claimed in claim 1, characterised by subjecting the film to ultrasonic energy.

26. A method as claimed in claim 1, characterised by subjecting the film to electronic energy.

27. A method as claimed in claim 1, characterised by subjecting the film to ionic energy.

28. A method as claimed in claim 1, characterised by subjecting the film to electrochemical energy.

29. A method as claimed in claim 1, characterised by subjecting the film to electromagnetic energy.

30. A method as claimed in claim 1, characterised by subjecting the film to nuclear energy.

31. A method as claimed in claim 1, characterised by applying the transformable substance to said flexible film to a measured extent.

32. A method as claimed in claim 6, characterised by applying the transformable substance to the entire surface of said flexible film and administering energy to a measured extent.

33. A method as claimed in claim 6, characterised by applying a protective further film to the flexible film after the transformable substance has been applied.

34. A method as claimed in claim 6, characterised by applying the transformable substance to the flexible film, to which energy is then administered subsequently by the user.

35. A method as claimed in claim 6, characterised by the forming step includes subjecting the flexible film to punching after the transformable substance has been transformed, to obtain in this manner a flat empty package which is substantially filled by the user.

36. A method as claimed in claim 6, characterised by applying the transformable substance in correspondence with the point from which the package contents are to be delivered.

37. A method as claimed in claim 1, characterised in that after the transformable polymer substance has been transformed, the flexible film is folded over and joined together along its longitudinal edges during the forming step to form a tubular element, which is then welded transversely, filled, closed, separated from the tubular element and formed to assume the predetermined final configuration of the package.

38. A method as claimed in claim 1, characterised in that while the film is being treated with the transformable substance it is made to undergo said forming step within a mould to form therein trays with at least corners thereof stiffened.

39. A method as claimed in claim 6, characterised by applying to the flexible film a second flexible film of transformable material and administering energy to the combination to a measured extent in correspondence with those regions which in the obtained object are required to be substantially rigid.

40. A method as claimed in claim 6, characterised by applying to the flexible film one of the two components of a two-component polymerization or cross-linking system, and applying the second component at the time of forming the element, at least one of the two components being applied to a measured extent.

* * * * *